US011148132B2

(12) United States Patent
Döbele

(10) Patent No.: US 11,148,132 B2
(45) Date of Patent: Oct. 19, 2021

(54) MANUAL METERING DEVICE

(71) Applicant: IKA-Werke GmbH & Co. KG, Staufen (DE)

(72) Inventor: Philip Döbele, Freiburg (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 175 days.

(21) Appl. No.: 16/348,747

(22) PCT Filed: Sep. 22, 2017

(86) PCT No.: PCT/EP2017/001128
§ 371 (c)(1),
(2) Date: May 9, 2019

(87) PCT Pub. No.: WO2018/086719
PCT Pub. Date: May 17, 2018

(65) Prior Publication Data
US 2019/0321816 A1 Oct. 24, 2019

(30) Foreign Application Priority Data
Nov. 14, 2016 (DE) ..... 10 2016 121 815.4

(51) Int. Cl.
*B01L 3/02* (2006.01)

(52) U.S. Cl.
CPC ..... *B01L 3/0217* (2013.01); *B01L 3/0286* (2013.01); *B01L 2200/025* (2013.01); *B01L 2200/087* (2013.01)

(58) Field of Classification Search
None
See application file for complete search history.

(56) References Cited

U.S. PATENT DOCUMENTS

| | | | | |
|---|---|---|---|---|
| 4,905,526 | A * | 3/1990 | Magnussen, Jr. ..... | B01L 3/0227 73/864.18 |
| 8,728,408 | B2 | 5/2014 | Strzelczyk | |
| 2008/0184823 | A1* | 8/2008 | Kneucker ..... | B01L 3/0217 73/864.16 |
| 2014/0137672 | A1 | 5/2014 | Gehrig et al. | |
| 2016/0199830 | A1* | 7/2016 | LaCroix ..... | B01L 3/0217 73/864.13 |

FOREIGN PATENT DOCUMENTS

| | | | |
|---|---|---|---|
| DE | 102004055562 | A1 | 6/2006 |
| DE | 102005041183 | B3 | 1/2007 |
| DE | 102007006076 | A1 | 1/2008 |
| EP | 2962759 | A1 | 1/2016 |

OTHER PUBLICATIONS

International Search Report from PCT Application No. PCT/EP2017/001128, dated Nov. 24, 2017.

* cited by examiner

*Primary Examiner* — Matthew D Krcha
*Assistant Examiner* — Brittany I Fisher
(74) *Attorney, Agent, or Firm* — Budzyn IP Law, LLC

(57) ABSTRACT

The manual dosing device (1) comprises the main body (3) that can be screwed to the fluid discharge unit (4), the detent connection (10) being provided alongside the screw connection (6) for removably connecting the main body (3) to the fluid discharge unit (4), which detent connection is locked by connecting the main body (3) and the fluid discharge unit (4) together (cf. FIG. 5).

21 Claims, 2 Drawing Sheets

MANUAL METERING DEVICE

FIELD OF THE INVENTION

The invention relates to a manual dosing device, in particular a pipette, with a main body and with a fluid discharge unit, wherein the main body comprises displacement means for displacing a fluid, i.e. for example for taking up or discharging a fluid, in particular a liquid, into or out of a pipette tip, and actuation means for actuating the displacement means, and wherein the main body and the fluid discharge unit are removably connected to one another by means of a screw connection.

BACKGROUND OF THE INVENTION

Such manual dosing devices are already known in various embodiments from the prior art. They are used as what are referred to as dispensers or also as what are referred to as pipettes. For cleaning the manual dosing devices, it is advantageous to be able to remove the fluid discharge unit from the main body. To this end, the main body and the fluid discharge unit can be removably connected to one another by means of a screw connection. However, particularly when connecting the main body to the fluid discharge unit, it should be ensured that the screw connection is tightened sufficiently, but not excessively. If the screw connection is too loose, the precision of the manual dosing device may be negatively affected. If the screw connection is tightened excessively, the parts of the manual dosing device that are connected to one another may be damaged.

SUMMARY OF THE INVENTION

The object of the invention is therefore to provide a manual dosing device of the type mentioned at the outset in which the main body and the fluid discharge unit can be reliably connected to one another with minimal effort.

This object is addressed by a manual dosing device of the type mentioned at the outset with the means and features of claim 1 and in particular by providing a detent connection between the main body and the fluid discharge unit, which detent connection is lockable by screwing the fluid discharge unit and the main body together.

In this way, what is provided is a manual dosing device that provides the user with acoustic and haptic feedback through the locking of the detent connection between the main body and the fluid discharge unit indicating that the screw connection between the fluid discharge unit and the main body has reached its correct end position, i.e. that the screw connection has been tightened sufficiently, but not excessively.

In this way, a user of the manual dosing device can screw the main body and the fluid discharge unit together without having to pay particular attention to whether the screw connection is too loose or too tight.

In other words, with the manual dosing device according to the invention, a connection between the main body and the fluid discharge unit is thus provided that allows, by means of a screw connection, the correspondingly advantageous tight connection between both parts of the manual dosing device, without however particular care having to be taken that the connection between the parts is made correctly. This is because the user of the manual dosing device receives feedback from the manual dosing device regarding the successful completion of the screw connection procedure in the form of the detent connection tangibly and/or audibly locking in. In this way, it is possible for the screw connection to be tightened in an identical manner repeatedly.

In relation to this, it may be expedient for the screw connection to comprise a thread and a counterthread. In this case, the thread can be formed on the main body and the counterthread formed on the fluid discharge unit. It is further possible for the detent connection to comprise at least one detent element arranged on the main body and at least one counterdetent element arranged on the fluid discharge unit. In this case, provision may then be made for it to be possible for the at least one detent element and the at least one counterdetent element to be locked together by screwing the thread and the counterthread together.

To be able to produce the acoustic and/or haptic feedback, described above, by making the detent connection once the screw connection has reached its correct end position and the main body is connected to the fluid discharge unit, it may be advantageous for the detent element and the counterdetent element to be formed and arranged such that they can be locked together, i.e. engage with one another, by screwing the thread and the counterthread together until a defined screw position is reached, in particular until an end position of the screw connection, in which the main body and the fluid discharge unit are connected together as intended, is reached.

In one embodiment of the manual dosing device according to the invention, provision may be made for the at least one detent element to be a detent notch and the at least one counterdetent element to be a detent protrusion. In another embodiment of the manual dosing device according to the invention, provision may be made for the at least one detent element to be a detent protrusion and the at least one counterdetent element to be a detent notch.

It may be particularly advantageous for at least two or more, preferably regularly arranged, detent elements to be provided on the main body, which detent elements are distributed around a longitudinal center axis of the main body, and at least two or three, preferably regularly arranged, counterdetent elements to be provided on the fluid discharge unit, which counterdetent elements are distributed around a longitudinal center axis of the fluid discharge unit. It is thus possible for the attachment of the fluid discharge unit, in its securing position, to the main body to be defined sufficiently by means of the at least two detent elements and the at least two counterdetent elements. In this case, there may be the same number of counterdetent elements as detent elements present.

Preferably however, the main body is provided with a number of detent elements corresponding to an integer multiple of, in particular double, triple or quadruple, the number of counterdetent elements on the fluid discharge unit. Thus, for example, six detent elements can be formed on the main body and three counterdetent elements can be formed on the fluid discharge unit. This may facilitate the connection of the fluid discharge unit to the main body by screwing and the locking of the detent connection.

It is possible for the at least one detent element to be arranged, preferably axially, adjacent to the thread and the at least one counterdetent element to be arranged, preferably axially, adjacent to the counterthread.

It may be additionally advantageous for the main body to have a threaded connector on which the thread is formed, in particular as an internal thread. Correspondingly, the fluid discharge unit may have a counterthreaded connector on which the counterthread is formed, in particular as an external thread. The at least one detent element may then also be formed on the threaded connector of the main body next to the thread and the at least one counterdetent element also be formed on the counterthreaded connector next to the counterthread.

In this case, the threaded connector and/or the counterthreaded connector may be made of an elastically deformable material, for example of plastic.

Since both the at least one detent element and the at least one counterdetent element are then each formed on a radially inwardly elastically deformable hollow structure, namely on the threaded connector and on the counterthreaded connector, respectively, it is possible for them to be able to disengage in the radial direction when making the detent connection. As such, it may thus also be preferable for the threaded connector to be designed such that it is elastically deformable in the radial direction. Connectedly, it may also be advantageous for the counterthreaded connector to be designed such that it is elastically deformable in the radial direction. This may promote the long-term functioning of the detent connection between the main body and the fluid discharge unit.

It may be additionally advantageous for the at least one detent element and the at least one counterdetent element to extend in the radial direction and in the axial direction on the main body and on the fluid discharge unit, respectively. In particular in the case of detent elements or counterdetent elements in the form of detent protrusions, the axial extension of the detent protrusions may be used so that the detent protrusions serve as defined axial stops. Such an axial stop, which may then be produced via a suitable mutually matching design of the detent elements and counterdetent elements, may be advantageous in that the fluid discharge unit may always be arranged in the same axial position relative to the main body. Were the at least one detent element and the at least one counterdetent element not to provide any such axial stop, it would be possible, under certain circumstances, to continue to turn the fluid discharge unit even after locking of the detent connection.

If the at least one detent element and the at least one counterdetent element each have cants or sloping surfaces that are complementary to one another, by means of which the detent connection can be opened when the screw connection is loosened, it is possible to separate and connect the main body from/to the fluid discharge unit repeatedly without damaging the detent connection.

To limit an axial screwing-in depth of the screw connection, the main body may have at least one axial stop and the fluid discharge unit may have at least one matching axial counterstop. In this case, the at least one detent element may form the at least one axial stop and the at least one counterdetent element may form the at least one axial counterstop. In this way, the detent element and the counterdetent element may perform a dual function.

The fluid discharge unit may be a plunger unit with a cylinder and with a plunger that is able to move within the cylinder and that can be connected to the displacement means.

It is further possible for the main body to comprise a housing. In this way, the components of the main body may be protected from outside influences, in particular from contamination or damage. In this case, it is possible for the thread and/or the at least one detent element to be arranged on the housing of the main body.

It is further possible for the fluid discharge unit to have a means for removably holding a pipette tip. This means may be a shaft, to the free end of which a pipette tip can be attached or is attached.

To improve the handling of the manual dosing device, the manual dosing device may have an, in particular manually actuated, ejector unit for ejecting a, for example the aforementioned, pipette tip.

BRIEF DESCRIPTION OF THE DRAWINGS

An exemplary embodiment of the invention is described in more detail below with reference to the drawing, parts of which are highly schematic and which shows.

DETAILED DESCRIPTION OF THE INVENTION

Figure 1:
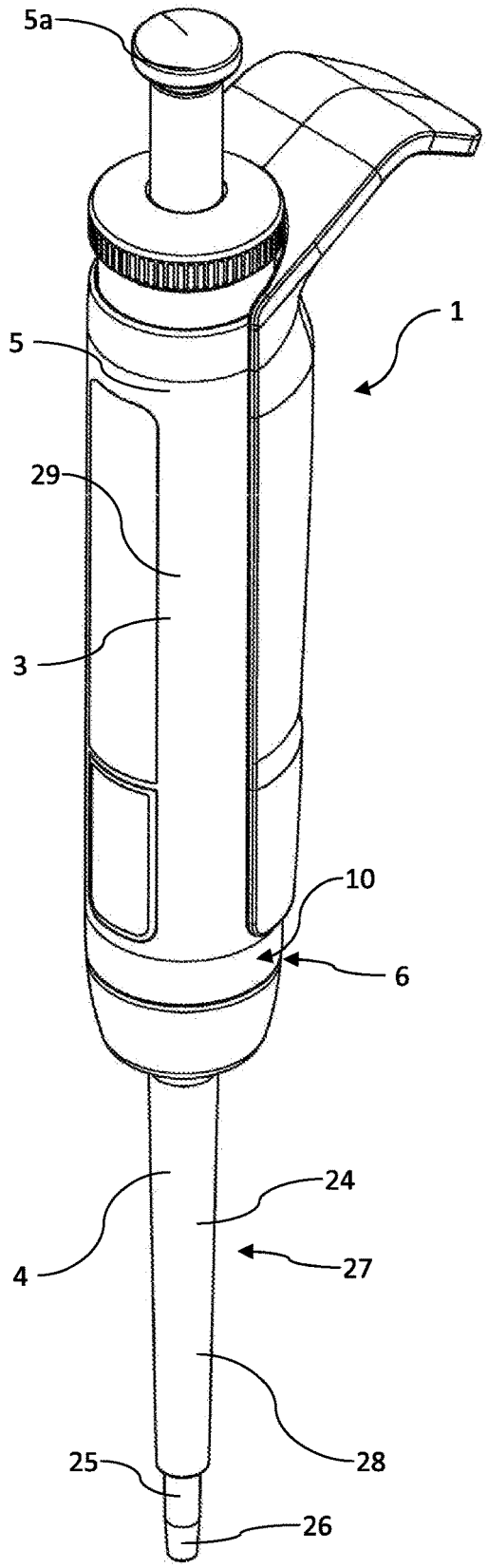
FIG. 1 a perspective view of a manual dosing device according to the invention in the form of a pipette.
Figure 2:
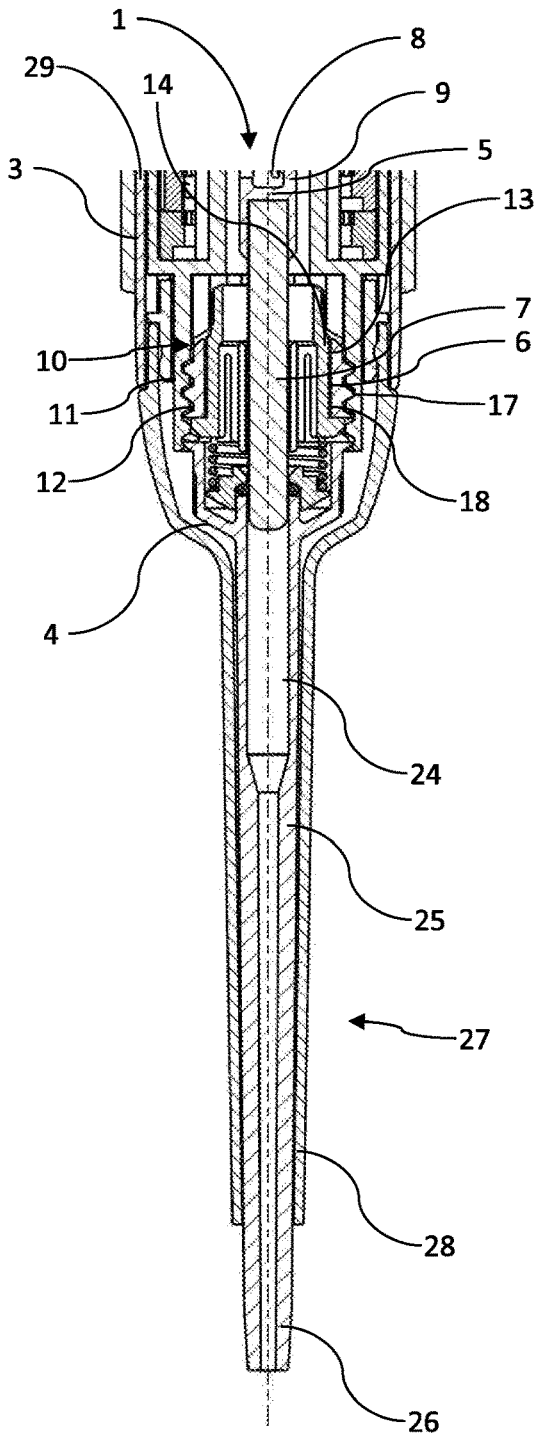
FIG. 2 a partial sectional representation of the manual dosing device shown in FIG. 1.

FIGS. 1 to 6 show various views of a manual dosing device, denoted as a whole by 1. The manual dosing device shown in the figures is in the form of a mechanical, manually actuated pipette. The manual dosing device 1 has a main body 3 and a fluid discharge unit 4. The main body 3 comprises displacement means 5 for displacing a fluid within the fluid discharge unit 4 and an actuation means **5*a* in the form of a pushbutton for actuating the displacement means 5. The main body 3 and the fluid discharge unit 4 are removably connected to one another by means of a screw connection 6. The displacement means 5 takes the form of a plunger rod 8 that is connected to a plunger 7 of the fluid discharge unit 4, as can be partially seen in FIG. 2**.

Plunger 7 and plunger rod 8 are connected to one another via a connecting part 9.

A detent connection 10 is provided between the main body 3 and the fluid discharge unit 4, which detent connection is lockable by screwing the fluid discharge unit 4 and the main body 3 together.

The screw connection 6 comprises a thread 11 on the main body 3 and a counterthread 12 on the fluid discharge unit 4.

The detent connection 10 comprises a plurality of detent elements 13 arranged on the main body 3 and a plurality of complementarily formed counterdetent elements 14 arranged on the fluid discharge unit 4. The detent elements 13 and the counterdetent elements 14 are arranged on the main body 3 and on the fluid discharge unit 4, respectively, such that they can be locked together by screwing the thread 11 and the counterthread 12 together. The detent elements 13 and the counterdetent elements 14 are arranged on the main body 3 and on the fluid discharge unit 4, distributed regularly around a longitudinal center axis L of the main body 3 and of the fluid discharge unit 4, respectively. In total, six detent elements 13 are formed on the main body 3 and three counterdetent elements 14 are formed on the fluid discharge unit 4. There are therefore twice as many detent elements 13 as counterdetent elements 14 present.

The detent elements 13 and the counterdetent elements 14 are locked together by screwing the thread 11 and the counterthread 12 together until a defined screw position is reached, which here represents an end position of the screw connection 6, in which the main body 3 and the fluid discharge unit 4 are connected together as intended.

In this way, the user of the manual dosing device 1 receives acoustic and haptic feedback through the locking of the detent connection 10 once the fluid discharge unit 4 is connected to the main body 3 as intended.

Figure 3:
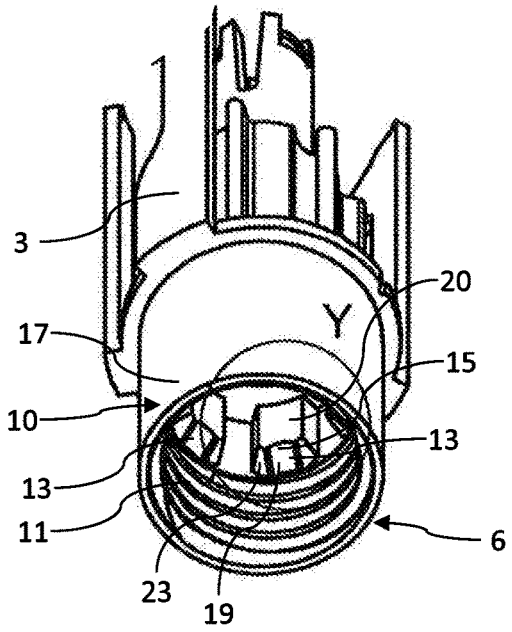
FIG. 3 a perspective view of a lower part of a main body of the manual dosing device shown in FIGS. 1 and 2, wherein it is possible to see, on the main body, a threaded connector in which a thread, taking the form of an internal thread, and a plurality of regularly arranged detent elements, distributed around a longitudinal center axis of the main body and taking the form of detent notches or detent hollows, are formed.
Figure 4:
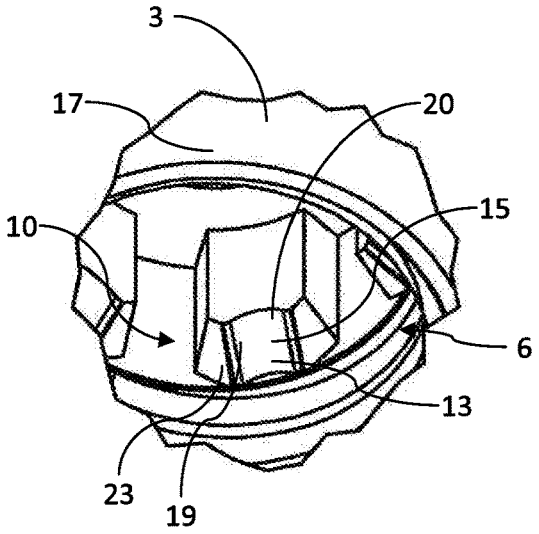
FIG. 4 an enlarged representation of the Y-marked circled detail in FIG. 3.
Figure 5:
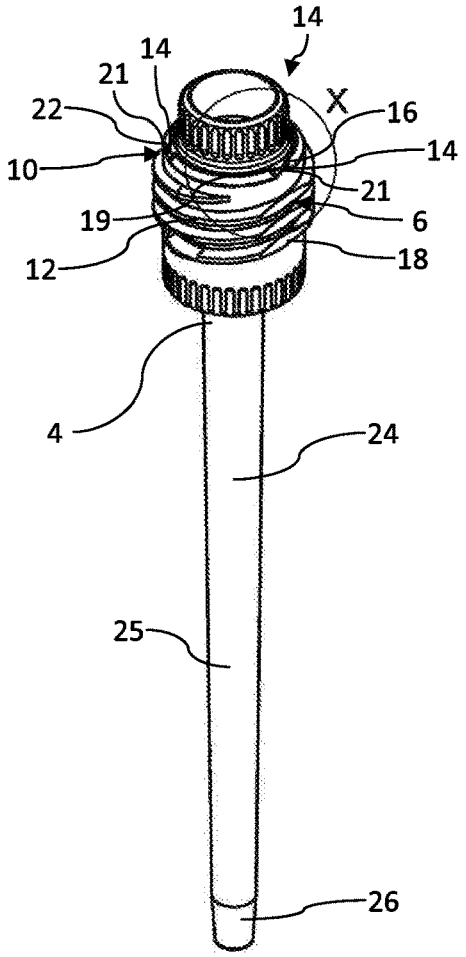
FIG. 5 a perspective view of a fluid discharge unit of the manual dosing device shown in FIGS. 1 and 2, wherein the fluid discharge unit takes the form of a plunger unit, on the end of which that faces the main body in the position of use it is possible to see a counterthreaded connector with a counterthread and with a plurality of regularly arranged counterdetent elements, distributed around a longitudinal axis of the fluid discharge unit and taking the form of knobs or detent protrusions.
Figure 6:
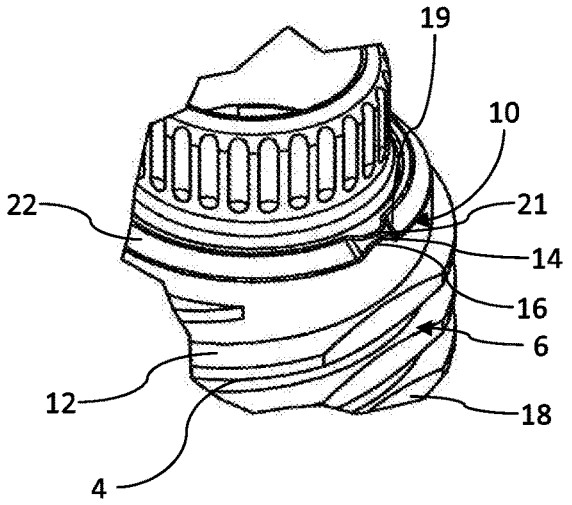
FIG. 6 an enlarged representation of the X-marked circled detail in FIG. 5.

As shown in FIGS. 3 and 4 in particular, the detent elements 13 arranged on the main body 3 take the form of detent notches 15 in the shape of hollows. The counterdetent elements 14 arranged on the fluid discharge unit 4 are detent protrusions 16 in the shape of knobs. The detent elements 13 are axially adjacent to the thread 11 and arranged above it on the main body 3. Analogously, the counterdetent elements 14 are axially adjacent to the counterthread 12 and arranged above it on the fluid discharge unit 4.

The main body 3 has a threaded connector 17, on which the thread 11 and the detent elements 13 are formed. The fluid discharge unit 4 in turn has a matching counterthreaded connector 18, on which the counterthread 12 and the counterdetent elements 14 are formed. In the present exemplary embodiment of the manual dosing device 1, the thread 11 takes the form of an internal thread and the counterthread 12 takes the form of an external thread. Both the threaded connector 17 and the counterthreaded connector 18 are elastically deformable in the radial direction, so as to allow the detent connection 10 to lock and to unlock.

Both the detent elements 13 and the counterdetent elements 14 extend both in the axial direction and in the radial direction on the inner circumference of the threaded connector 17 and on the outer circumference of the counterthreaded connector 18, respectively.

The detent elements 13 and the counterdetent elements 14 each have cants or sloping surfaces 19 that are complementary to one another, by means of which the detent connection 10 can be reversibly opened when the screw connection 6 is loosened. Once a suitable torque applied to the screw connection 6 is reached, the detent protrusions 16 can thus slip out of the corresponding detent notches 15 and the detent connection 10 can be undone. This takes place through the implementation of a tangential movement, on loosening the screw connection 6, between the detent elements 13 and the counterdetent elements 14 via the complementary cants or sloping surfaces 19 in a radially acting motion of the counterdetent elements 14 relative to the detent elements 13, such that the counterdetent elements 14 and the detent elements 13 can be disengaged from one another.

The main body 3 has, inside the threaded connector 17, a plurality of regularly arranged stops 20, distributed around a longitudinal center axis L of the main body 3, for limiting the screwing-in depth of the screw connection 6. The counterdetent elements 14, which are arranged on a circumferential collar 22 of the fluid discharge unit 4, act as counterstops 21.

As shown in FIGS. 3 and 4 in particular, the detent elements 13 are arranged on an end face 23, facing the fluid discharge unit 4 in the position of use, of the stops 20 extending radially into the interior of the threaded connector 17.

The fluid discharge unit 4 is a plunger unit comprising a cylinder 24, within which the plunger 7 can be moved axially using the displacement means 5 in the form of the plunger rod 8, in order to take up or to discharge a defined volume of liquid using the manual dosing device 1.

FIG. 1 shows that the main body 3 is surrounded by a housing 29 of the manual dosing device 1.

The fluid discharge unit has a shaft 25, to the free end 26 of which a pipette tip can be attached. This shaft 25 is used, via its free end 26, as a means for removably holding a pipette tip.

For ejecting a pipette tip attached to the free end 26 of the shaft 25, the manual dosing device 1 has a manually actuated ejector unit 27. This ejector unit 27 comprises an ejector sleeve 28 that is axially movable relative to the shaft 25 of the fluid discharge unit 4, which ejector sleeve, by means of a corresponding ejector mechanism, can be manually moved axially relative to the shaft 25.

The manual dosing device 1 comprises the main body 3 that can be screwed to the fluid discharge unit 4, the detent connection 10 being provided alongside the screw connection 6 for removably connecting the main body 3 to the fluid discharge unit 4, which detent connection is locked by connecting the main body 3 and the fluid discharge unit 4 together.

What is claimed is:

1. A manual dosing device (1), in particular a pipettewith a main body (3) and with a fluid discharge unit (4), wherein the main body (3) comprises displacement means (5) for displacing a fluid and actuation means (5*a*) for actuating the displacement means (5), wherein the main body (3) and the fluid discharge unit (4) are removably connected to one another by means of a screw connection (6), and wherein a detent connection (10) is provided between the main body (3) and the fluid discharge unit (4), the detent connection being lockable by screwing the fluid discharge unit (4) and the main body (3) together, wherein the screw connection (6) comprises a thread and a counterthread (12), wherein the thread (11) is formed on the main body (3) and the counterthread (12) is formed on the fluid discharge unit (4), wherein the detent connection (10) comprises at least one detent element (13) arranged on the main body (3), adjacent to the thread (11), and at least one counterdetent element (14) arranged on the fluid discharge unit (4), adjacent to the counterthread (12), and wherein the at least one detent element (13) and the at least one counterdetent element (14) are locked together by screwing the thread (11) and the counterthread (12) together.

2. The manual dosing device (1) as claimed in claim 1, wherein the at least one detent element (13) and the at least one counterdetent element (14) are arranged such that they can be locked together by screwing the thread (11) and the counterthread (12) together until a predefined screw position is reached.

3. The manual dosing device (1) as claimed in claim 2, wherein the predefined screw position is an end position of the screw connection.

4. The manual dosing device (1) as claimed in claim 1, wherein the at least one detent element (13) is one of a detent notch (15) and a detent protrusion (16), and wherein the at least one counterdetent element is one of a detent notch and a detent protrusion.

5. The manual dosing device (1) as claimed in claim 1, wherein at least two detent elements (13) are provided on the main body (3) which are distributed around a longitudinal center axis (L) of the main body (3), and at least two counterdetent elements (14) are provided on the fluid discharge unit (4) which are distributed around a longitudinal center axis (L) of the fluid discharge unit (4).

6. The manual dosing device (1) as claimed in claim 5, wherein the detent elements (13) are regularly arranged on the main body (3) about the longitudinal center axis (L) of the main body (3).

7. The manual dosing device (1) as claimed in claim 5, wherein the counterdetent elements (14) are regularly arranged on the fluid discharge unit (4) about the longitudinal center axis (L) of the fluid discharge unit (4).

8. The manual dosing device (1) as claimed in claim 5, wherein the main body (3) is provided with a number of detent elements (13) corresponding to an integer multiple of the number of counterdetent elements (14) on the fluid discharge unit (4).

9. The manual dosing device (1) as claimed in claim 1, wherein the main body (3) has a radially elastically deformable, threaded connector (17), on which the thread (11) is formed and on which the at least one detent element (13) is formed, and wherein the fluid discharge unit (4) has a radially elastically deformable, counterthreaded connector (18), on which the counterthread (12) is formed, and on which the at least one counterdetent element (14) is formed.

10. The manual dosing device (1) as claimed in claim 9, wherein the thread (11) is formed as an internal thread on the threaded connector (17), and the counterthread (12) is formed as an external thread on the counterthreaded connector (18).

11. The manual dosing device (1) as claimed in claim 1, wherein the at least one detent element (13) and the at least one counterdetent element (14) extend in the radial direction and in the axial direction.

12. The manual dosing device (1) as claimed in claim 1, wherein the at least one detent element (13) and the at least one counterdetent element (14) have respective cants (19) that are complementary to one another, by means of which the detent connection can be opened when the screw connection is loosened.

13. The manual dosing device (1) as claimed in claim 1, wherein the main body (3) has at least one axial stop (20) and the fluid discharge unit (4) has at least one matching axial counterstop (21) for limiting the depth of the screw connection (6).

14. The manual dosing device (1) as claimed in claim 13, wherein the at least one detent (13) forms the at least one axial stop (20) and the at least one counterdetent element (14) forms the at least one axial counterstop (21).

15. The manual dosing device (1) as claimed in claim 1, wherein the fluid discharge unit (4) includes a cylinder (24) with a plunger (7) that is able to move within the cylinder (24), the plunger (7) being connected to the displacement means (5).

16. The manual dosing device (1) as claimed in claim 1, wherein the main body (3) has a housing (29).

17. The manual dosing device (1) as claimed in claim 1, wherein the fluid discharge unit (4) has a means (25, 26) for removably holding a pipette tip.

18. The manual dosing device (1) as claimed in claim 1, wherein the manual dosing device (1) has an ejector unit (27) for ejecting a pipette tip.

19. A manual dosing device (1), in particular a pipette, with a main body (3) and with a fluid discharge unit (4), wherein the main body (3) comprises displacement means (5) for displacing a fluid and actuation means (5*a*) for actuating the displacement means (5), wherein the main body (3) and the fluid discharge unit (4) are removably connected to one another by means of a screw connection (6), and wherein a detent connection (10) is provided between the main body (3) and the fluid discharge unit (4), the detent connection being lockable by screwing the fluid discharge unit (4) and the main body (3) together, wherein the screw connection (6) comprises a thread and a counterthread (12), wherein the thread (11) is formed on the main body (3) and the counterthread (12) is formed on the fluid discharge unit (4), wherein the detent connection (10) comprises at least one detent element (13) arranged on the main body (3) and at least one counterdetent element (14) arranged on the fluid discharge unit (4), and wherein the at least one detent element (13) and the at least one counterdetent element (14) are locked together by screwing the thread (11) and the counterthread (12) together, and, wherein the main body (3) has a radially elastically deformable, threaded connector (17), on which the thread (11) is formed and on which the at least one detent element (13) is formed, and wherein the fluid discharge unit (4) has a radially elastically deformable, counterthreaded connector (18), on which the counterthread (12) is formed, and on which the at least one counterdetent element (14) is formed.

20. A manual dosing device (1), in particular a pipette, with a main body (3) and with a fluid discharge unit (4), wherein the main body (3) comprises displacement means (5) for displacing a fluid and actuation means (5*a*) for actuating the displacement means (5), wherein the main body (3) and the fluid discharge unit (4) are removably connected to one another by means of a screw connection (6), and wherein a detent connection (10) is provided between the main body (3) and the fluid discharge unit (4), the detent connection being lockable by screwing the fluid discharge unit (4) and the main body (3) together, wherein the screw connection (6) comprises a thread and a counterthread (12), wherein the thread (11) is formed on the main body (3) and the counterthread (12) is formed on the fluid discharge unit (4), wherein the detent connection (10) comprises at least one detent element (13) arranged on the main body (3) and at least one counterdetent element (14) arranged on the fluid discharge unit (4), and wherein the at least one detent element (13) and the at least one counterdetent element (14) are locked together by screwing the thread (11) and the counterthread (12) together, and, wherein the at least one detent element (13) and the at least one counterdetent element (14) have respective cants (19) that are complementary to one another, by means of which the detent connection can be opened when the screw connection is loosened.

21. A manual dosing device (1), in particular a pipette, with a main body (3) and with a fluid discharge unit (4), wherein the main body (3) comprises displacement means (5) for displacing a fluid and actuation means (5*a*) for actuating the displacement means (5), wherein the main body (3) and the fluid discharge unit (4) are removably connected to one another by means of a screw connection (6), and wherein a detent connection (10) is provided between the main body (3) and the fluid discharge unit (4), the detent connection being lockable by screwing the fluid discharge unit (4) and the main body (3) together, wherein the screw connection (6) comprises a thread and a counterthread (12), wherein the thread (11) is formed on the main body (3) and the counterthread (12) is formed on the fluid discharge unit (4), wherein the detent connection (10) comprises at least one detent element (13) arranged on the main body (3) and at least one counterdetent element (14) arranged on the fluid discharge unit (4), and wherein the at least one detent element (13) and the at least one counterdetent element (14) are locked together by screwing the thread (11) and the counterthread (12) together, wherein the main body (3) has at least one axial stop (20) and the fluid discharge unit (4) has at least one matching axial counterstop (21) for limiting the depth of the screw connection (6), and, wherein the at least one detent (13) forms the at least one axial stop (20) and the at least one counterdetent element (14) forms the at least one axial counterstop (21).

* * * * *